US006477714B1

(12) United States Patent
Boatwright

(10) Patent No.: US 6,477,714 B1
(45) Date of Patent: Nov. 12, 2002

(54) HAT CLIP

(76) Inventor: Donald Jeffrey Boatwright, 5710 Mount Holly Huntersville Rd., Charlotte, NC (US) 28216

( * ) Notice: Subject to any disclaimer, the term of this patent is extended or adjusted under 35 U.S.C. 154(b) by 0 days.

(21) Appl. No.: 10/012,863

(22) Filed: Nov. 30, 2001

(51) Int. Cl.[7] ..... A42B 1/24
(52) U.S. Cl. ..... 2/171; 2/209.13
(58) Field of Search ..... 2/171, 171.01, 2/209.12, 209.13, 175.1, 175.4, 175.5, 195.1, 195.5, 195.6, 195.7, 200.3; 40/586, 329, 312, 662

(56) References Cited

U.S. PATENT DOCUMENTS 2,408,318 A * 9/1946 Josephs ..... 40/329
2,648,847 A * 8/1953 Crowder ..... 2/209.13
2,693,370 A 11/1954 Wheatley
3,829,995 A * 8/1974 Fakoury ..... 40/386
4,375,296 A 3/1983 Chang
4,389,801 A * 6/1983 Sharrock et al. ..... 40/586
4,628,572 A 12/1986 Chang
4,667,274 A * 5/1987 Daniel ..... 2/209.13
5,116,012 A 5/1992 Offenhauer
5,253,368 A * 10/1993 Blake ..... 2/209.13
5,276,985 A * 1/1994 Halloran ..... 40/329
5,774,946 A 7/1998 Morgan
6,339,866 B1 * 1/2002 French ..... 2/195.1

* cited by examiner

*Primary Examiner*—Gloria M. Hale

(57) ABSTRACT

A card or note holder (12) to be attached to the underside of the bill of a hat (34) for the purpose of keeping to do lists, check lists, or reminders in a very convenient location which can be used to take notes and record ideas when they are encountered and before they are forgotten. The outer portion of the flat clip(s) (16) is closely connected to the inner portion of the clip(s) or flat plate (14) in manner which grips the outer edge(s) of a card (30) or multiple cards while allowing the card(s) to be removed and replaced easily.

6 Claims, 4 Drawing Sheets

HAT CLIP

FEDERALLY SPONSORED RESEARCH

Not Applicable

SEQUENCE LISTING OR PROGRAM

Not Applicable

BACKGROUND—Field of Invention

Figure 1D:
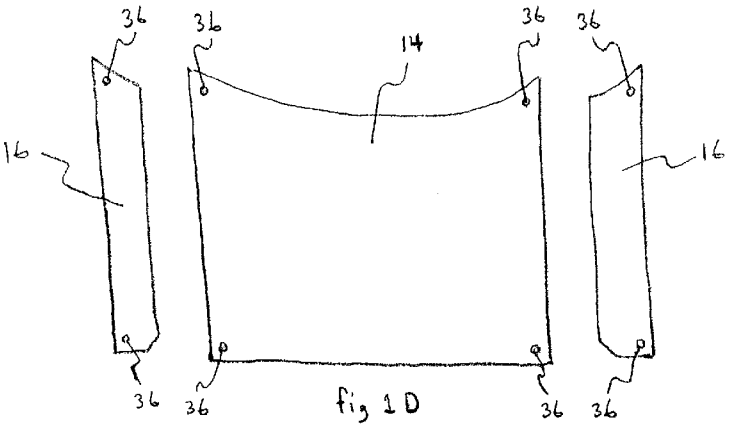

This invention relates to hats or caps, specifically to a device, which allows the user to clip note cards, notepaper, or other similar cards or flat items onto the underside of the bill of a hat which has this device attached, and allows the user to keep the note cards or other flat items attached to their hat for easily assessable use.

BACKGROUND—Description of Prior Art

Clipboards have been around for many years, which allow users to have a portable surface to write on and keep their notes and documents clipped together in a convenient manner.

Several types of clip boards and clip devises have previously been proposed—for example, in U.S. Pat. No. 2,693,370 (1954), U.S. Pat. No. 4,375,296 (1983), U.S. Pat. No. 4,628,572 (1986), U.S. Pat. No. 5,116,012 (1992), and U.S. Pat. No. 5,774,946 (1998). All of these patents provide very useful capabilities for holding papers together, but none of these or any others provide the capabilities of my patent which allows cards, paper, or other flat items to be secured to the bill of a user's hat or cap.

U.S. Pat. No. 2,693,370 (1954) describes a devise which uses a magnetic devise to clamp or hold the papers in place. U.S. Pat. No. 4,375,296 (1983) describes a clip board devise which uses a spring type clamp to hold the papers in place. U.S. Pat. No. 4,628,572 (1986) describes a clip structure devise which provides advantages for easy assembly and low cost of manufacture of the more typical clip board. U.S. Pat. No. 5,116,012 (1992) describes another clip board devise which uses a special type of clamp and flat board to hold the papers in place. U.S. Pat. No. 5,774,946 (1998) describes another clip structure devise which includes a base and a pivotally mounted clip part, which is not and could not be used on the bill of a hat. Although these inventions are very useful for various size sheets of paper, they must be carried in hand by the user or attached to the user's vehicle or something other than the user's hat.

Again, no existing prior art allows the user to clip note cards, notepaper, or other flat items onto the underside of the bill of a hat which has the Hat Clip attached, and allows the user to keep the note cards or other similar cards attached to their hat or cap for easily assessable use.

Objects and Advantages

Accordingly, several objects and advantages of my invention are:

(a) to provide a very convenient means for a user, when wearing a hat, to keep notes or cards for the purpose of taking notes or to keep reminders or checklists handy without having to carry a clip-board in hand.

(b) to provide a very convenient means for a user, when wearing a hat, to keep notes or cards for the purpose of taking notes or to keep reminders or checklists handy without having to have a clip-board attached to the windshield or other part of a vehicle.

(c) to provide a very convenient means for a user, when wearing a hat, to keep notes or cards for the purpose of taking notes or to keep reminders or checklists handy without having to carry a clip-board in a brief-case or backpack.

(d) when the devise is constructed of a light weight metal such as aluminum, the user also has an added capability of being able to bend the bill of his or her hat along with the thin flat portion of the device to a desirable curvature which will be maintained.

Further objects and advantages are to provide the advantages of a small clip-board without having to keep up with the clip-board, since a clip-board can not be part of the user's hat. The advantages of being able to keep notes or cards immediately available for the purpose of taking notes or to keep reminders or checklists, while being totally out of the way and having your hands free are numerous. A user who is wearing a hat with this invention attached to the bill of the hat can now take notes or bring reminders and checklist with him or her anywhere he or she goes. And since the notes or cards are attached to the underside of the bill of the hat with this invention, the notes or reminders are not totally out of sight or mind. The user will be more likely to remember what he or she is supposed to do or at least check the note or card to see what it is they are supposed to remember. And they will also have the ability to write down additional notes when they remember something else that was not written down previously. This invention allows users to be able to write down important ideas and information when they think of them at any time without having to carry around a clip-board or pocket notepad or tape recorder.

SUMMARY

This invention allows the user to attach or secure a card or piece of paper to the bill of his or her hat and be able to remove or replace the card or paper with another (or the same) card by simply pulling the existing card out and sliding a new (or the same) card back in place. This invention comprises a card holding device to be used on the underside of the bill of a hat or cap. The area of the device is slightly larger than the cards or flat items to be held. The preferred embodiment includes a flat piece of plastic or metal slightly larger than the cards to be held to which the outer portions of the clips are attached. An additional embodiment of the present invention consists of two end clips without the previously described flat portion, which are attached to the underside of the bill of a hat or cap in a similar manner. The device is made of metal or plastic, and is attached to the underside of the bill of a hat or cap which is typically a baseball type cap. The end clips provide a means for gripping each side of the card(s) and allow the card(s) to be removed and put back into place without using a typical pivoting type of clip. The holding pressure of the clips result from the tightness of the screws, bolts, or rivets, which anchor the device in four locations to the bill of the hat or cap. When screws or bolts are used, the tightness of the clips can be adjusted to hold a particular number of cards in place as desired by the user. Again, the device is attached to the hat by means of screws, bolts, or rivets, which penetrate through the bill of the hat and the device in four locations. The device could also be attached to the bill of the hat or cap by use of two sided tape, glue, or Velcro, but without the capability to adjust the tightness of the clips.

DRAWINGS

Drawing Figures

In the drawings, closely related figures have the same number but different alphabetic suffixes.

Figure 1C:
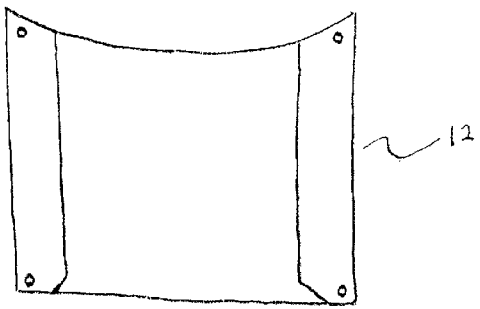
Figure 1B:
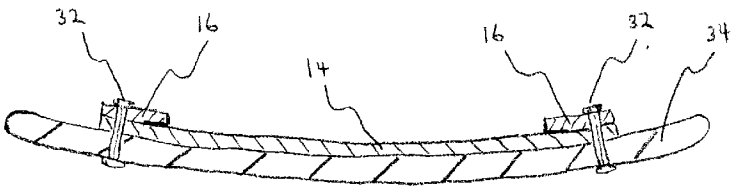
Figure 1A:
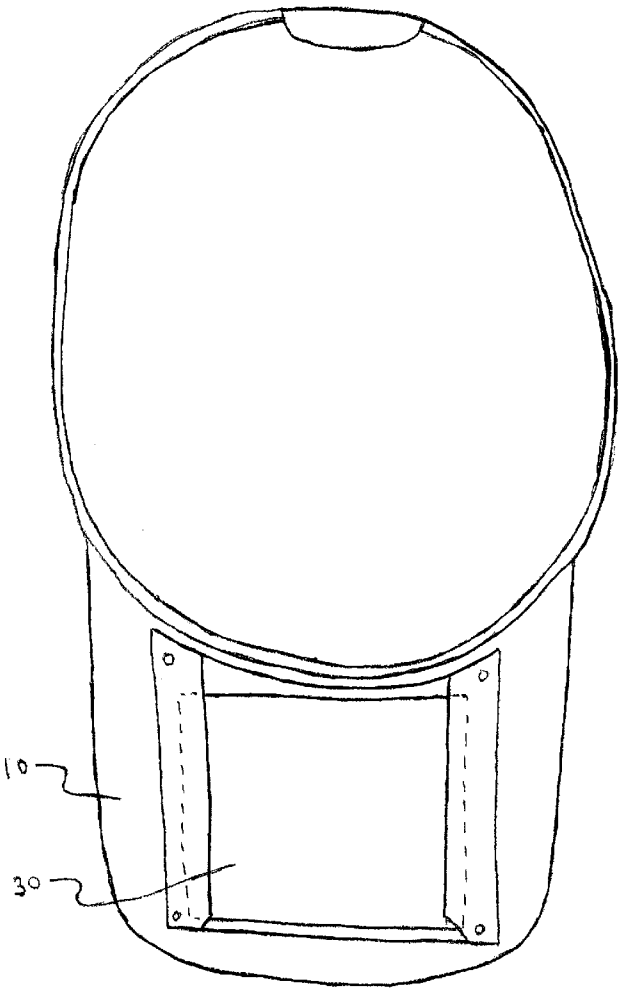

FIG. 1A shows underside plan view of a hat and the invention comprising the three component construction including the flat plate portion which is slightly larger than the card or cards to be held and two separate end clip components. FIG. 1B shows a section view of a hat bill and the three component construction of this invention. FIG. 1C shows a plan view of the three component construction of this invention with all pieces together. FIG. 1D shows an exploded plan view of the three component construction of this invention with all pieces separated.

Figure 2D:
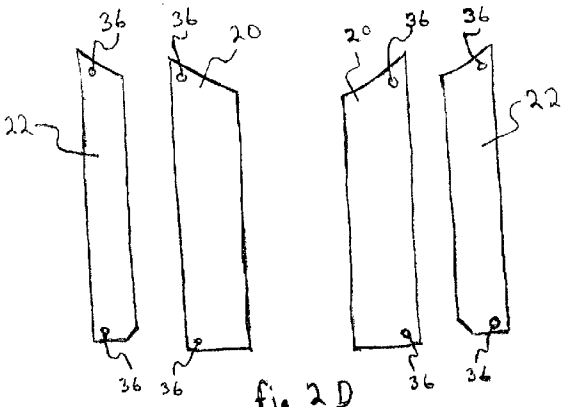
Figure 2C:
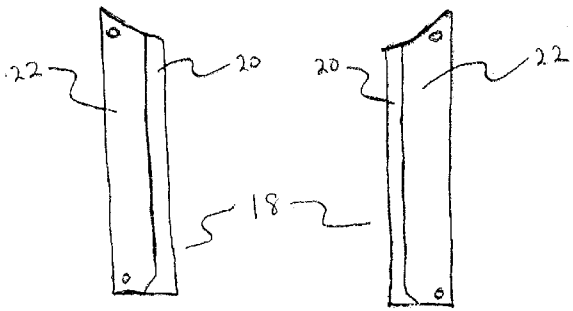
Figure 2B:
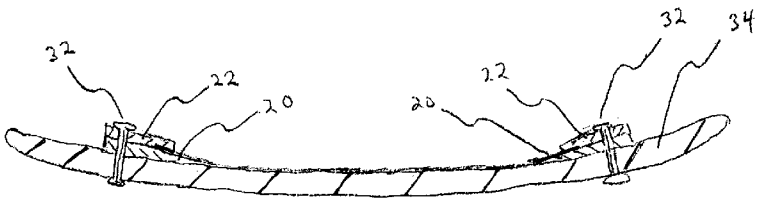
Figure 2A:
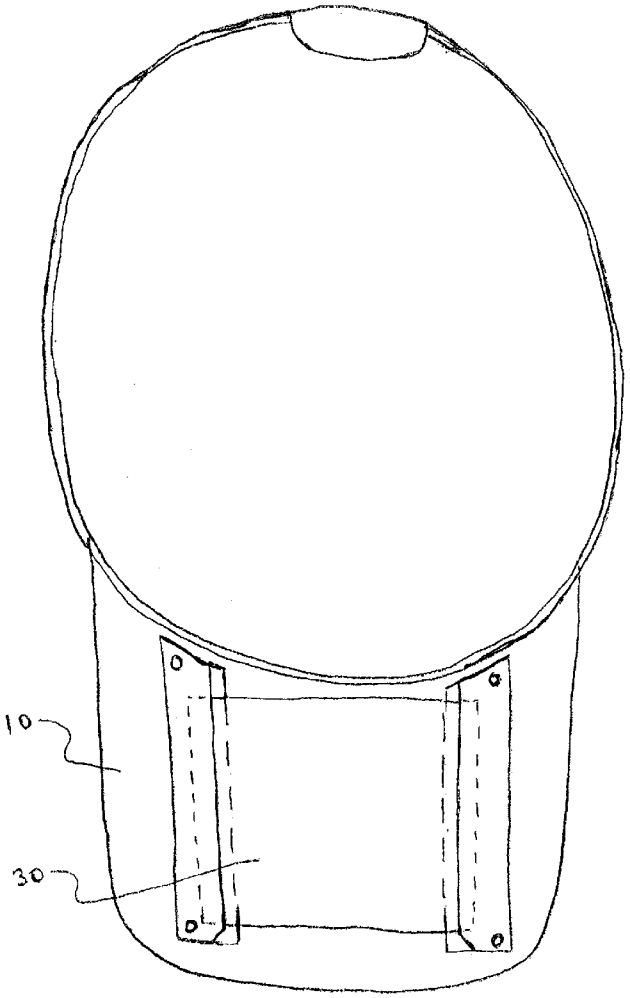

FIG. 2A shows underside plan view of a hat and the invention comprising the four component construction including both end clips. FIG. 2B shows a section view of a hat bill and the four component construction of this invention. FIG. 2C shows a plan view of the four component construction of this invention with all pieces together. FIG. 2D shows an exploded plan view of the four component construction of this invention with all pieces separated.

Figure 3D:
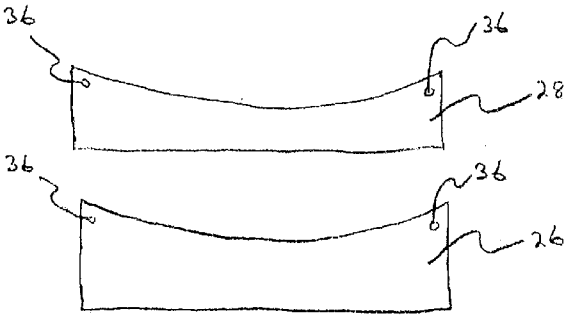
Figure 3C:
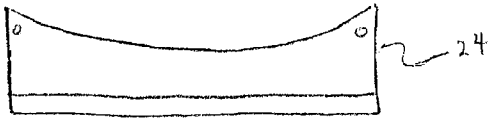
Figure 3B:
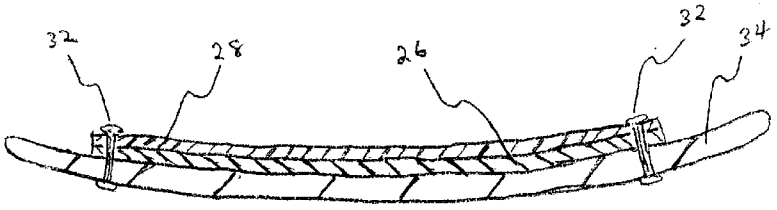
Figure 3A:
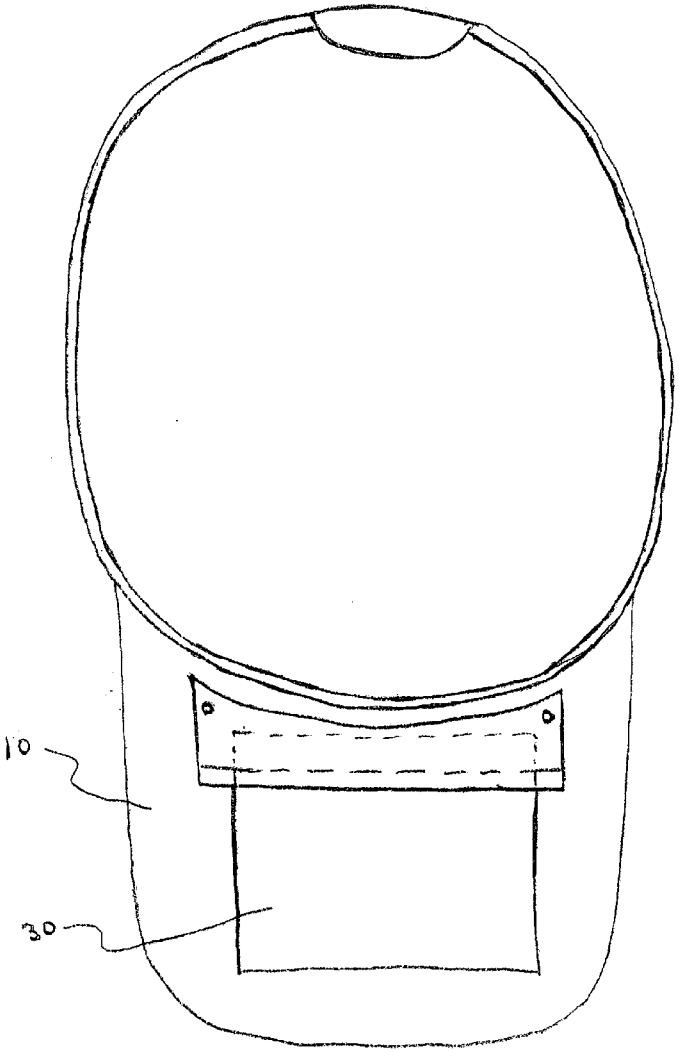

FIG. 3A shows underside plan view of a hat and the invention comprising the two component construction including the single clip. FIG. 3B shows a section view of a hat bill and the two component construction of this invention. FIG. 3C shows a plan view of the two component construction of this invention with both pieces together. FIG. 3D shows an exploded plan view of the two component construction of this invention with both pieces separated.

Figure 4C:
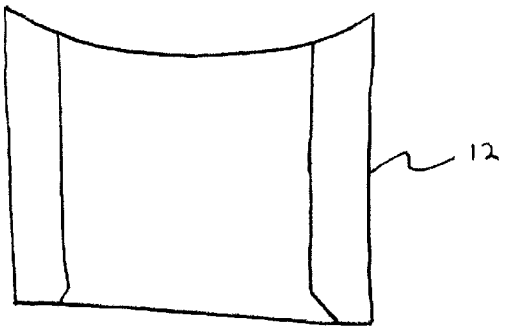
Figure 4B:
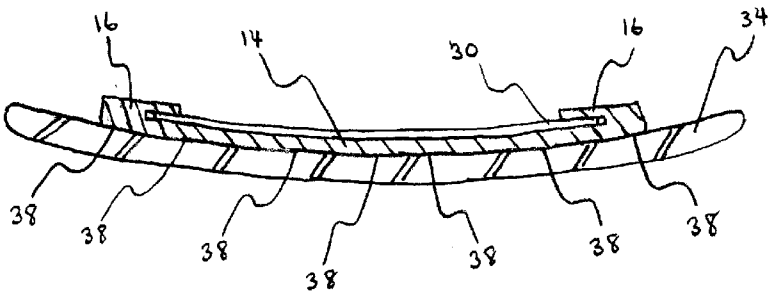
Figure 4A:
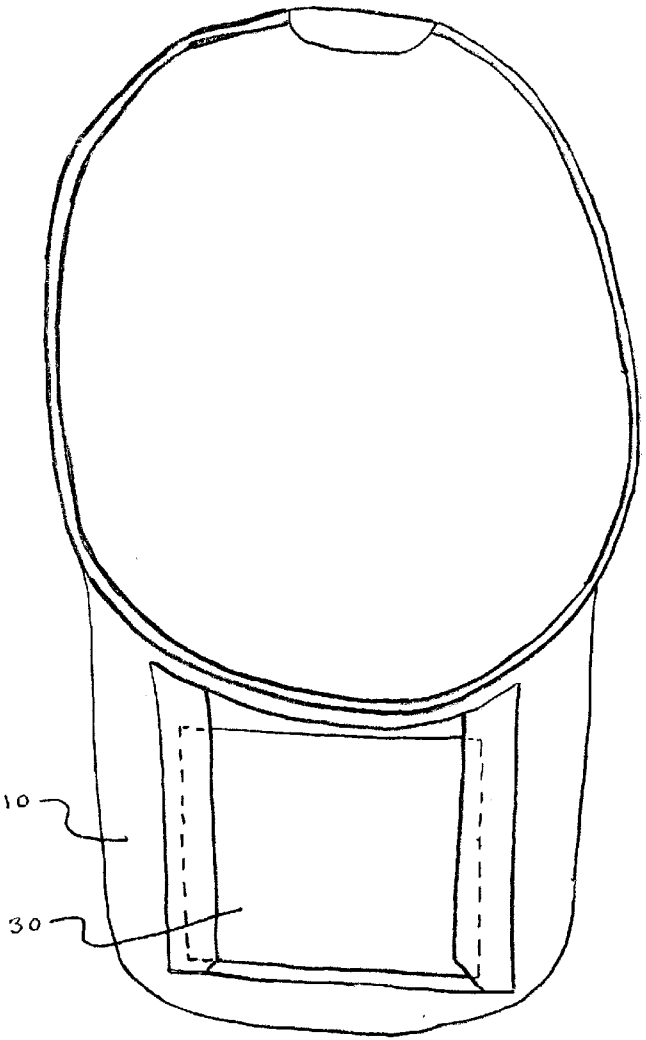

FIG. 4A shows underside plan view of a hat and the invention comprising the flat plate portion and the two outer clips constructed as a single component and attached to the bill of the hat with two sided tape or pressure sensitive adhesive. FIG. 4B shows a section view of a hat bill and this single component construction. FIG. 4C shows a plan view of this single component construction.

REFERENCE NUMERALS IN DRAWINGS

10 underside of bill of cap or hat
12 three component device with flat plate and end clips
14 inner flat plate (three component device)
16 outer clip pieces (three component device)
18 four component device (two clip device without flat plate)
20 inner clip pieces (four component device)
22 outer clip pieces (four component device)
24 two component device (single clip device)
26 inner clip piece (two component devise)
28 outer clip piece (two component devise)
30 card
32 male/female bolt (or other fastening device such as rivets or screws)
34 bill of cap or hat
36 hole for bolt or other fastening device
38 two sided tape or pressure sensitive adhesive

DETAILED DESCRIPTION

Description FIGS. 1A–1D—Preferred Embodiment

A preferred embodiment of the present invention is illustrated in FIG. 1A, FIG. 1B, FIG. 1C, and FIG. 1D. This embodiment consists of three pieces along with fastening devices, including a flat plate piece 14, which is slightly larger than the card or cards 30 to be held against the underside of the bill of the hat 10, and two outer clip pieces 16. These three components can be constructed of plastic or light weight metal such as aluminum. The inner flat piece 14 is approximately two to four inches in width by approximately four to six inches, in length, and approximately 1/32nd to 1/8th inch in thickness. The outer clip pieces 16 are approximately two to four inches in length which is the same as the width of the flat plate piece 14, approximately one half to one inch in width, and approximately 1/32nd to 1/8th thickness. The flat clip pieces 16 are connected on top and at the sides of the inner flat plate piece 14, which rest directly against the underside of the bill of the hat 10. One side of each outer clip piece 16 and one side of the inner flat plate piece 14 are typically formed with a curvature to match the curvature of the inside edge of the bill of the hat 10, as shown in FIG. 1A. The inner corner of each clip piece 16 is typically beveled or rounded to allow easy insertion of cards, as shown FIG. 1A. This embodiment can also consist of a flat plate portion and clips which are constructed as a single component as shown if FIG 4A. A thin slot is provided between the inner and outer portions where the edges would be held in place.

The outer flat clip pieces 16 are closely connected to the inner flat plate 14 in a manner which allows the outer edges of a card 30 or multiple cards to be held in place while also allowing the card(s) to be removed and replaced easily. The end clips provide a means for gripping each end of the card(s). The holding pressure of the clips 16 results from the tightness of the screws, bolts, or rivets 32, which anchor the device in four locations to the underside of the bill of the hat or cap 10. Fastener holes 36 are formed in both the clip pieces 16 and the flat plate piece 14 in the locations as shown in FIG. 1D. When male-female bolt-screw fasteners 32 are used, the tightness of the clips can be adjusted to hold a particular number of cards in place as desired by the user.

The device is attached to the underside of the bill of the hat by means of screws, bolts, or rivets 32, which penetrate through the bill of the hat 34 and the device in four locations. This device when manufactured as a single component as described above, would be attached to the bill of the hat or cap 34 by use of two sided tape 38, adhesive, or hook and loop fastners.

FIGS. 2A–2D—Additional Embodiments

An additional embodiment of my invention is illustrated in FIG. 2A, FIG. 2B, FIG. 2C, and FIG. 2D. This embodiment is constructed of four pieces along with fastening devices, including two pieces for each clip. Each of the gripping clips is composed of a two pieces of plastic, metal, or wood. Each clip is composed of an inner piece 20 and outer piece 22 which is of similar shape. The inner piece 20 is slightly wider than the outer piece 22. Each clip is approximately two to four inches in length, approximately one half to one inch in width and approximately 1/16th to 1/4th of an inch in thickness. The inner portion of each clip 20 is approximately 1/32nd to 1/8th inch in thickness. The outer portion of each clip 22 is also approximately 1/32nd to 1/8th inch in thickness. Each clip is comprised of two similar pieces of plastic, metal, or wood, which are held together on the outer long side to create the two-piece clip, of which there are two. The outer clip pieces 22 are connected on top and at the sides of the inner clip pieces 20, which rest directly against the underside of the bill of the hat 10. One side of each outer clip piece 22 and one side of each inner clip piece 14 are typically formed with a curvature to match the curvature of the inside edge of the bill of the hat 10, as shown in FIG. 2A. The inner corner of each outer clip piece 22 is typically beveled or rounded to allow easy insertion of cards, as shown FIG. 2A. This embodiment can also consist of clips which are composed of a single component which is manufactured to be of the same shape as the previously mentioned two piece construction; this method of manufacture would require a thin slot or slit to be cut between the inner and outer portions where the card edges would be held in place.

The outer flat clip pieces 22 are closely connected to the inner flat clip pieces 20 in a manner which allows the outer edges of a card 30 or multiple cards to be held in place while also allowing the card(s) to be removed and replaced easily. The clips provide a means for gripping each end of the card(s). The holding pressure of the clips results from the tightness of the screws, bolts, or rivets 32, which anchor the device in four locations to the underside of the bill of the hat or cap 10. Fastener holes 36 are formed in both the outer clip pieces 22 and the inner clip pieces 20 in the locations as shown in FIG. 2D. When male-female bolt-screw fasteners 32 are used, the tightness of the clips can be adjusted to hold a particular number of cards in place as desired by the user.

The device is attached to the underside of the bill of the hat by means of screws, bolts, or rivets 32, which penetrate through the bill of the hat 34 and the device in four locations. This device when manufactured as a single component as described above, could also be attached to the bill of the hat or cap 34 by use of two sided tape, adhesive, or Velcro, but without the capability to adjust the tightness of the clips.

FIGS. 3A–3D—Alternative Embodiments

An alternative embodiment of the parts of my invention is illustrated in FIG. 3A, FIG. 3B, FIG. 3C, and FIG. 3C. This embodiment is constructed of two pieces for a single clip along with fastening devices. The single gripping clip is composed of a two pieces of plastic, metal, or wood. The clip is composed of an inner piece 26 and outer piece 28 which is of similar shape. The inner piece 26 is slightly wider than the outer piece 28. The clip is approximately three to six inches in length, approximately one half to one inch in width and approximately 1/16th to 1/4th of an inch in depth. The inner portion 26 of each clip is approximately 1/32nd to 1/8th inch in thickness. The outer portion 28 of each clip is also approximately 1/32nd to 1/8th inch in thickness. The clip is comprised of two similar pieces of plastic, metal, or wood, which are held together on the outer long side to create the two-piece clip. The outer clip piece 28 is connected on top and at the back of the inner clip piece 26, which rest directly against the underside of the bill of the hat 10. The back side of both the outer clip piece 28 and the inner clip piece 26 are typically formed with a curvature to match the curvature of the inside edge of the bill of the hat 10, as shown in FIG. 3A. This embodiment can also consist of a clip which is composed of a single component which is manufactured to be of the same shape as the previously mentioned two piece construction; this method of manufacture would require a thin slot or slit to be cut between the inner and outer portions where the card edge would be held in place.

The outer flat clip piece 28 is closely connected to the inner flat clip piece 26 in a manner which allows the outer edge of a card 30 or multiple cards to be held in place while also allowing the card(s) to be removed and replaced easily. The clip provides a means for gripping the edge of the card(s). The holding pressure of the clip results from the tightness of the screws, bolts, or rivets 32, which anchor the device in two locations to the underside of the bill of the hat or cap 10. Fastener holes 36 are formed in both the outer clip piece 28 and the inner clip piece 26 in the locations as shown in FIG. 3D. When male-female bolt-screw fasteners 32 are used, the tightness of the clips can be adjusted to hold a particular number of cards in place as desired by the user.

The device is attached to the underside of the bill of the hat 10 by means of screws, bolts, or rivets 32, which penetrate through the bill of the hat 34 and the device in two locations. This device when manufactured as a single component as described above, could also be attached to the bill of the hat or cap 34 by use of two sided tape, adhesive, or Velcro, but without the capability to adjust the tightness of the clip.

Operation—FIGS. 1–3

The manner of using this invention is very simple and consists of the user taking off his or her hat or cap and removing a card 30 from or sliding a card 30 into the device which is attached to the underside of the bill 34 of the hat or cap. If notes are to be made on the outer card, then the card does not have to be removed from the device.

The preferred embodiment of the invention shown if FIG. 1 also allows a user to use an erasable pen to write directly on the plastic flat plate surface 14 when the flat plate piece 14 is composed of a smooth finish white plastic just like would be done on a typical erasable white board. The preferred embodiment of the invention would also allow a user to use the flat plate piece 14 of the devise to shape his or her cap bill 34 if the flat plate component 14 is composed of a light weight metal such as aluminum which is bendable.

CONCLUSION, RAMIFICATIONS, AND SCOPE

The following additional advantages of this invention are great over any of the existing prior art.

- No other clipboard type devise allows the user to keep notes in a convenient location such as this, on his hat right in front of his eyes. When the user stores his note cards on the bill of his or her hat or cap, the user can't help but to see the note card in his or her upper peripheral vision, and because of this he or she is less likely to forget to use his or her note card which may consists of very important To Do Tasks. The old saying "Out of sight, out of mind" won't happen!
- Not only are the note cards stored in a place which makes it hard to forget, but they can be accessed very easily when new ideas come to mind and need to be written down.
- This invention also allows the user to remove and replace cards into and out of the brackets very easily, thus allowing the user to check off items on his or her checklists or add new To Do tasks or ideas to the card or cards.
- Some of the many benefits this invention provides are: convenient To Do lists, convenient check lists, a convenient method to record ideas immediately before they are forgotten, storage of golf game cards, storage on any small cards, storage of very important reminders such as motivational sayings, or even photographs or pictures or the American Flag.
- This invention allows the user all of the previously mentioned benefits without having to carry a clipboard in their hand, or in a pocket book, or in a back pack, anywhere else on their person.

This invention can be constructed in various ways as described above in the various embodiments, but each offers a similar unique benefit to a user as never before realized. The invention can be made of various types of plastic, wood, or metal. Plastic appears to be the most logical and economical choice in terms of costs and ease of manufacturing.

Construction of this invention with a type of plastic which allows erasable ink to be wiped off easily from the flat plate embodiment of the devise offers additional capabilities for quick note taking if cards are not preferred. Also, the flat plate embodiment which can be made of a light weight metal such as aluminum can be used which allows the user to shape the bill of the use's cap.

I claim:

1. A card holding device attached to an underside of a bill of a hat or cap comprising:

(a) an inner flat plate piece slightly larger in area than a card or cards to be held against said bill of said hat;

(b) two outer clip pieces;

(c) fasteners, for connecting said outer clip pieces to said flat plate piece, and to said bill of said hat, (d) said outer clip pieces and said inner flat plate secure said card or cards to said hat or cap so as to enable said card or cards to be removed and replaced conveniently and, (e) wherein said flat plate piece and said outer clip pieces are composed of any one of plastic or metal.

2. A card holding device of claim 1 wherein said flat plate piece and said two outer clip pieces are constructed as a single component and said fasteners include two sided tape or pressure sensitive adhesive.

3. A card holding device attached to an underside of a bill of a hat or cap comprising:

(a) two inner clip pieces;

(b) two outer clip pieces;

(c) fasteners, for connecting said outer clip pieces to said inner clip pieces, and to said bill of said hat, (d) said outer clip pieces and said inner clip pieces secure said card or cards to said hat or cap so as to enable said card or cards to be removed and replaced conveniently and, (e) wherein said inner clip pieces and said outer clip pieces are composed of any one of plastic, metal, or wood.

4. A card holding device of claim 3 wherein said inner clip pieces and said outer clip pieces are comprised of two integral pieces for securing said card or cards to said hat or cap so as to enable said card or cards to be removed or replaced conveniently.

5. A card holding device attached to an underside of a bill of a hat or cap comprising:

(a) one inner clip piece;

(b) one outer clip piece;

(c) fasteners, for connecting said outer clip piece to said inner clip piece, and to said bill of said hat, (d) said outer clip piece and said inner clip piece secure said card or cards to said hat or cap so as to enable said card or cards to be removed and replaced conveniently and, (e) wherein said inner clip piece and said outer clip piece are composed of any one of plastic, metal, or wood.

6. A card holding device of claim 5 wherein said inner clip piece and said outer clip piece are comprised of a single integral piece for securing said card or cards to said hat or cap so as to enable said card or cards to be removed or replaced conveniently.

* * * * *